US006038776A

United States Patent [19]

Yamada et al.

[11] Patent Number: 6,038,776

[45] Date of Patent: Mar. 21, 2000

[54] AUTOMATIC DRAFTING MACHINE

[75] Inventors: Yoshikuni Yamada; Shinya Nozawa; Yutaka Yamada, all of Tokyo, Japan

[73] Assignee: Mutoh Industries Ltd., Tokyo, Japan

[21] Appl. No.: 08/779,610

[22] Filed: Jan. 7, 1997

[30] Foreign Application Priority Data

Jul. 19, 1996 [JP] Japan ..... 8-209138

[51] Int. Cl.[7] ..... B43L 13/00

[52] U.S. Cl. ..... 33/18.1; 33/623; 271/183; 271/228; 347/104

[58] Field of Search ..... 33/18.1, 32.1, 33/32.3, 32.4, 32.5, 32.6, 32.7, 501.02, 623; 271/265.01, 227, 183, 226, 228, 258, 3.17; 346/134; 400/630, 633, 579, 636.1; 347/104; 399/388, 316, 397

[56] References Cited

U.S. PATENT DOCUMENTS

| | | | |
|---|---|---|---|
| 3,424,357 | 1/1969 | Curtze et al. | 33/32.1 |
| 4,101,018 | 7/1978 | Sokolowski | 400/582 |
| 4,225,872 | 9/1980 | Marinoff | 400/636.1 |
| 4,734,987 | 4/1988 | Cleveland | 33/18.1 |
| 4,792,131 | 12/1988 | Akiyama | 271/7 |
| 4,792,249 | 12/1988 | Lahr | 400/579 |
| 5,182,861 | 2/1993 | Suzuki et al. | 33/1 M |

FOREIGN PATENT DOCUMENTS

| | | | |
|---|---|---|---|
| 4334470 | 11/1992 | Japan | 400/579 |

*Primary Examiner*—Andrew H. Hirshfeld
*Attorney, Agent, or Firm*—Sughrue, Mion, Zinn, Macpeak & Seas, PLLC

[57] ABSTRACT

An operator separates pressure rollers 14, 16 from the corresponding drive rollers 12 for a predetermined distance prior to his drawing work on the paper and allows the paper 18 to be inserted between the drive rollers 12 and the pressure rollers 14, 16 from the front of the platen 2. An optical sensor 28 detects the paper 18. A controller drives a fan after a lapse of a predetermined time to operate a vacuum power in a vacuum chamber 4. Thereafter, the paper 18 on the platen 2 continues to be held on the platen 2 by the vacuum power. In this condition, the operator sets the paper to a mark 20 drawn on the platen 2 which indicates a set position of the paper to adjust the position of the paper 18. When the operator completes the positioning of the paper 18, he manipulates the lever to lift down the pressure rollers. Thereafter, the pressure rollers 14, 16 contact the drive rollers 12 over the paper 18 resiliently by a predetermined pressure, and the paper 18 is sandwiched between the drive rollers 12 and the pressure rollers 14, 16 on the platen 2. Finally, the controller stops the drive of a fan 30 and the arrangement of the paper is completed.

1 Claim, 3 Drawing Sheets

AUTOMATIC DRAFTING MACHINE

BACKGROUND OF THE INVENTION

The Japanese Utility Model Laid-Open Publication No. H3-88795 disclosed a paper arranging device for paper drive type automatic drafting machine in which a hold roller is separated from a drive roller when the paper on a platen is to be set, and while the paper is set on a guide provided on a platen, the paper is caused to be inserted between the drive roller and the hold roller, and the hold roller is lifted down while the paper is held down by hand to set the paper.

In the conventional paper arranging device as described above, in case the paper was of a big size such as A1 and A0, the paper arranging work was carried out by holding the paper down with both hands so as to keep the paper from falling from the platen. For this reason, there was a problem of an extremely poor manipulation.

Furthermore, there was a problem that when the paper was to be set, if the paper floated from the platen, the paper was set in a tilted position when a pressure roller was lowered and the paper was carried away while being in the tilt.

A primary object of this invention is to solve the foregoing problems.

SUMMARY OF THE INVENTION

This invention relates to automatic drafting machines such as plotters, printers or the like for performing drafting work using a pen or inkjet head, and more particularly to a paper arranging mechanism for arranging the paper to set on the platen easily.

This invention makes it possible to separate pressure rollers from corresponding drive rollers for a predetermined distance by manipulating a lever and the like. An operator separates the pressure rollers from the corresponding drive rollers for a predetermined distance prior to his drawing work on the paper and allows the paper to be inserted between the drive rollers and the pressure rollers from the forward of the platen. When the paper is caused to be inserted between the drive rollers and the pressure rollers, an optical sensor detects the paper. A controller drives a fan after a lapse of a predetermined time to operate a vacuum power in a vacuum chamber. Thereafter, the paper on the platen continues to be held on the platen by the vacuum power. In this condition, the operator used a mark drawn on the platen which indicates a set position of the paper to adjust the position of the paper. When the operator completes the positioning of the paper, he manipulates a lever to lift down the pressure rollers. Thereafter, the pressure rollers contact the drive rollers over the paper resiliently with a predetermined power, and the paper is sandwiched between the drive rollers and the pressure rollers. Then, the controller stops the drive of the fan and the arrangement of the paper is completed.

In this invention, as described above, since, a vacuum is provided for arranging the paper to be set on the platen, an arrangement of the paper can be carried out easily. During the paper arrangement, even if the operator takes his or her hands off the paper, the falling of the paper does not occur. Furthermore, the paper is not set in a tilted position when the pressure roller is lifted down because the paper does not float from the platen at the time of arranging the paper.

DETAILED DESCRIPTION OF THE INVENTION

Hereinbelow, a construction of this invention will be described in detail by referring to attached drawings.

Figure 2:
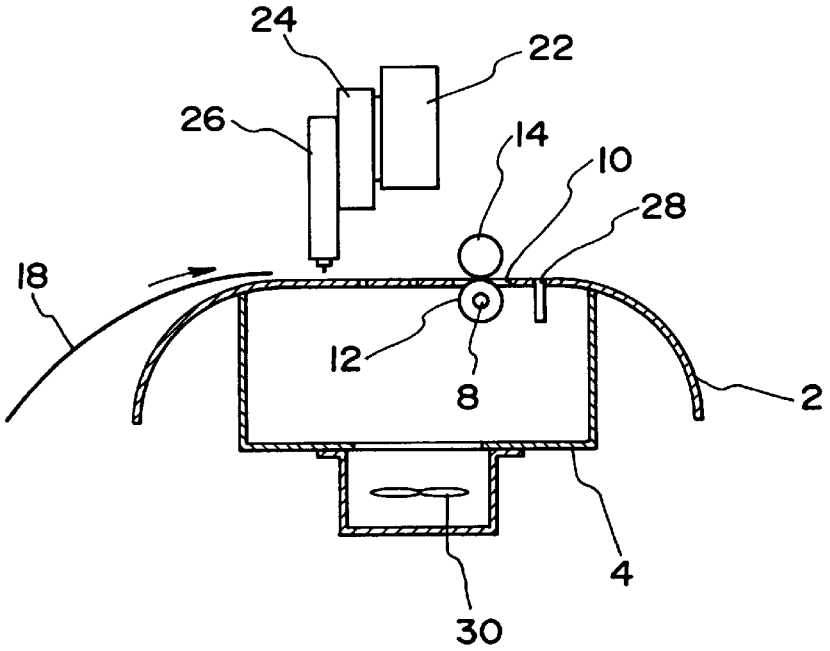
FIG. 2 is a side view of an automatic drafting machine according to this invention.
Figure 3:
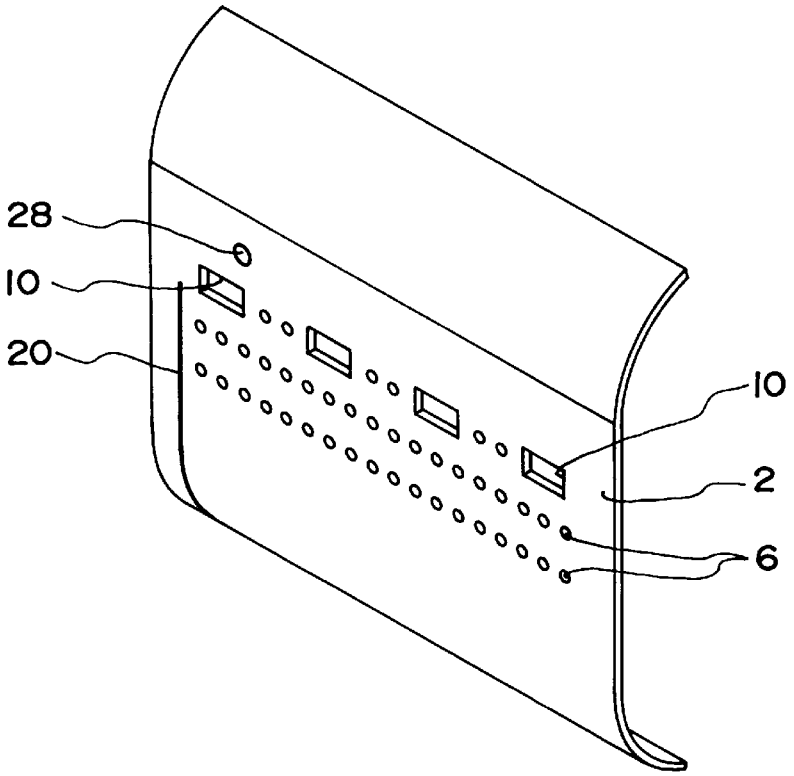
FIG. 3 is an exterior view of a platen of the automatic drafting machine.

FIG. 2 shows an automatic drafting machine such a pen-type or inkjet-type plotter, printer or the like, and in the drawing, reference numeral 2 denotes a platen constituting a paper guide support surface. The platen 2 is fixed to a body proper of the automatic drafting machine. In the lower part of a central portion of the platen 2, a vacuum chamber 4 is formed. In a predetermined range of the central portion of the platen 2, numerous perforations or suction holes 6 communicating with the vacuum chamber 4 are formed, which constitute a vacuum area. A drive shaft 8 connected to a drive motor is disposed beneath the platen 2, and drive rollers 12 disposed at opening portions 10 of the platen 2 are fixed to the drive shaft 8. Numerals 14, 16 denote pressure rollers which are disposed right above a pair of drive rollers 12 that corresponds to a paper width by means of a lifting mechanism. A mark 20 for positioning of a paper 18 is formed on the platen 2. Numeral 22 denotes a rail extending in a perpendicular direction of the paper surface in FIG. 2, and both ends of the rail are mounted on the body proper. A carrier 24 is shiftably mounted on the rail 22, and a drawing head 26 is supported on the carrier 24. The drawing head 26 may be of any type such as pen-type or inkjet-type. Numeral 28 denotes an optical sensor for detection of paper disposed on the platen 2, and is disposed behind the drive rollers 12.

In the foregoing construction, the paper 18 on the platen 2 is sandwiched by the pressure rollers 14, 16 and the drive rollers 12, and the paper 18 is carried in a back and forth direction of the platen 2 (right and left directions in FIG. 2) or one direction (right direction in FIG. 2) by the rotation of the drive rollers 12 with a control of the controller while the drawing head 26 is caused to reciprocate in a Y-axis direction along the rail 22, and drawing data transferred from a host computer is drawn on the paper.

Figure 1:
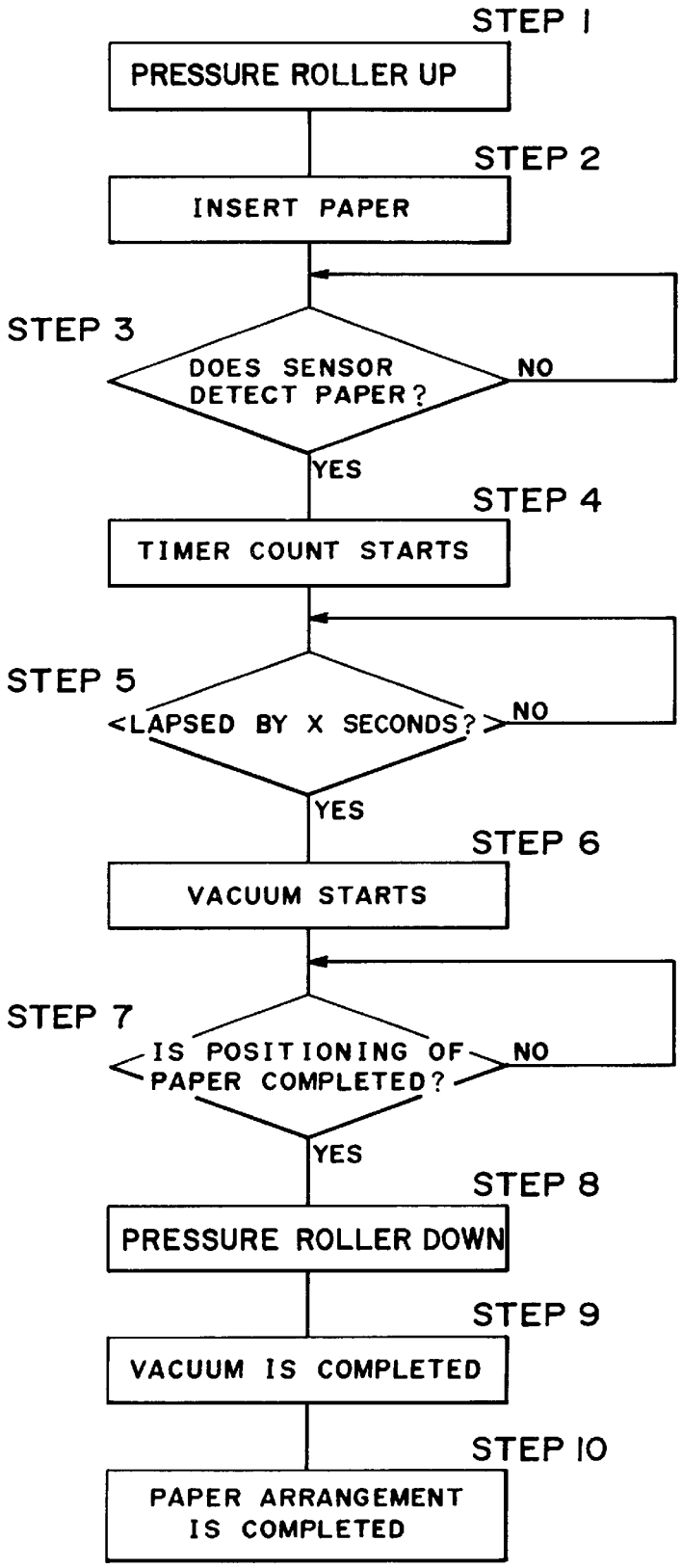
FIG. 1 is a flowchart showing an operation of this invention.
Figure 4:
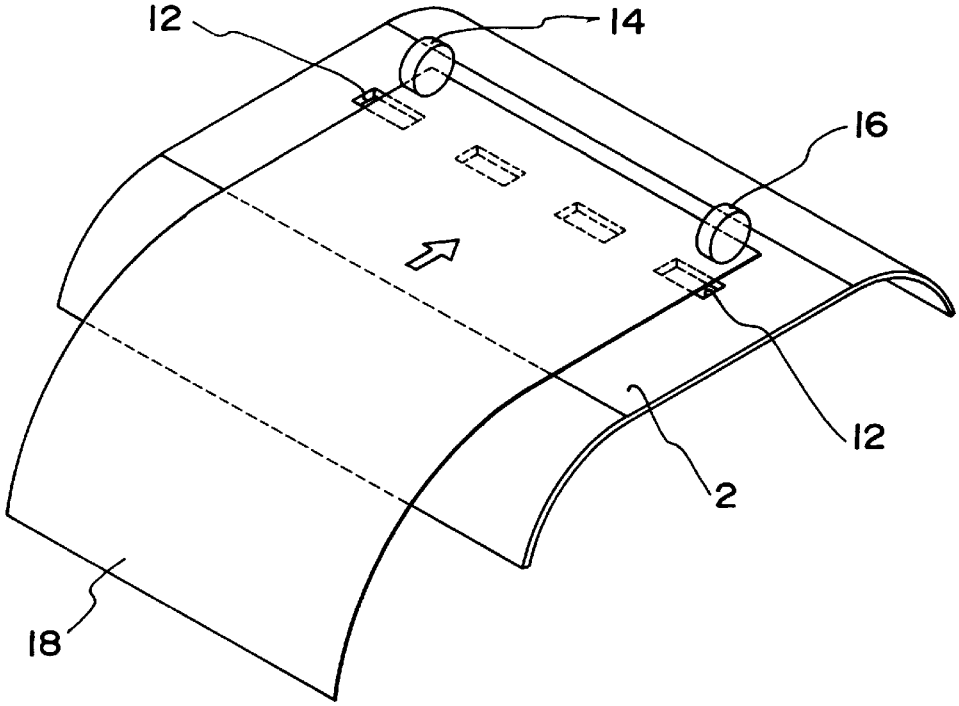
FIG. 4 is an operation explanation drawing of this invention.

Prior to the foregoing drawing operation, an operation of arranging the paper 18 to 17 on the platen 2 is described by referring to FIG. 1. First, the operator manipulates a keyboard or a lever of the body proper to lift the pressure rollers 14, 16 (step 1) which separates the pressure rollers 14, 16 from the corresponding drive rollers 12 by a predetermined distance. Next, as shown in FIG. 4, the paper 18 is caused to be inserted between the drive rollers 12 and the pressure rollers 14, 16 from the front of the platen 2 by a manual operation. When the optical sensor 28 detects the paper 18 (step 3), the controller drives a fan 30 after a lapse of a predetermined time on the basis of a detection signal of the sensor 28 to operate the vacuum power in a vacuum chamber 4 (steps 5 and 6).

By the foregoing operation, the paper 18 on the platen 2 is caused to be held on the platen 2 by the vacuum power. In this condition, the operator sets the paper to a mark 20 drawn on the platen 2 indicating the set position of the paper or a mark 20' consisting of a series of perforated holes shown in FIG. 5 to adjust the position of the paper 18. When the operator completes the positioning of the paper 18, he manipulates the keyboard or the lever to lift down the pressure rollers (step 8). By this operation, the pressure rollers 14, 16 contact the drive rollers 12 resiliently with a predetermined pressure over the paper 18, and the paper 18 is sandwiched between the drive rollers 12 and the pressure rollers 14, 16.

Next, the controller stops the drive of the fan 30, and completes the arrangement of the paper (steps 9 and 10). For reference, a time from the detection of the paper 18 by the optical sensor 28 until the operation of the vacuum may be almost simultaneous and may be several seconds apart considering a time for the paper 18 to pass between the drive rollers 12 and the pressure rollers 14, 16.

Figure 5:
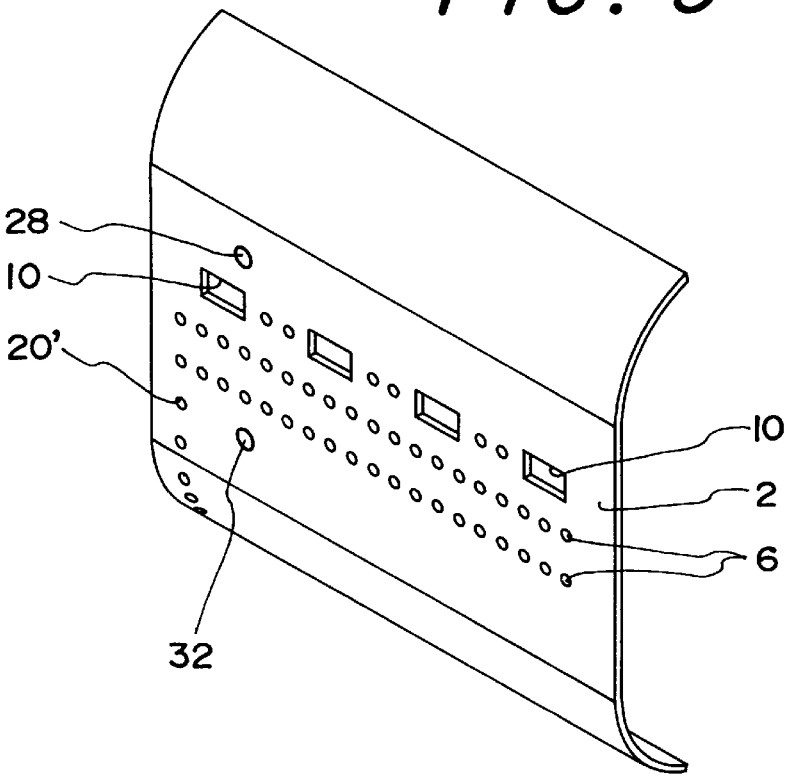
FIG. 5 is an exterior view showing a mode of another embodiment of the platen.

Furthermore, it is possible to arrange optical sensors 32, 28 for detection of paper, as shown in FIG. 5, in front and back of the platen 2 sandwiching the drive rollers 12, and the vacuum is caused to operate after the detection and recognition of the paper by both the optical sensors 32, 28. Furthermore, in this invention, the paper adsorption mechanisms is not limited particularly to a constitution utilizing the vacuum but an electrostatic adsorption mechanism and the like may be used.

What is claimed is:

1. An automatic drafting machine comprising:

a platen sandwiched by a drive roller and a corresponding pressure roller that is capable of moving toward and away from said drive roller, and a drawing head;

a paper adsorption mechanism associated with said platen; and a sensor associated with said platen for detecting a paper, wherein when the paper is set on said platen and said sensor detects the paper, said paper adsorption mechanism is turned on and the paper is adsorbed to said platen, and wherein said sensor is positioned behind said drive roller relative to said drawing head, the paper adsorption mechanism being turned on only after a leading edge of the paper is detected by the sensor and has passed between said drive roller and said pressure roller which are separated by a predetermined distance from each other, said pressure roller subsequently being pressed against said drive roller with the paper therebetween.

* * * * *